US009512832B2

(12) United States Patent
Yamamoto et al.

(10) Patent No.: US 9,512,832 B2
(45) Date of Patent: Dec. 6, 2016

(54) SWASH PLATE TYPE VARIABLE DISPLACEMENT COMPRESSOR

(71) Applicant: KABUSHIKI KAISHA TOYOTA JIDOSHOKKI, Aichi-ken (JP)

(72) Inventors: Shinya Yamamoto, Aichi-ken (JP); Hiroyuki Nakaima, Aichi-ken (JP); Kengo Sakakibara, Aichi-ken (JP); Yusuke Yamazaki, Aichi-ken (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 245 days.

(21) Appl. No.: 14/523,178

(22) Filed: Oct. 24, 2014

(65) Prior Publication Data

US 2015/0118074 A1 Apr. 30, 2015

(30) Foreign Application Priority Data

Oct. 31, 2013 (JP) ..... 2013-226212

(51) Int. Cl.
*F04B 27/18* (2006.01)
*F04B 27/10* (2006.01)

(52) U.S. Cl.
CPC ..... *F04B 27/1804* (2013.01); *F04B 27/10* (2013.01); *F04B 27/1054* (2013.01); *F04B 27/1072* (2013.01); *F04B 27/18* (2013.01)

(58) Field of Classification Search
CPC ..... F04B 27/1054; F04B 27/1063; F04B 27/1072; F04B 27/18; F04B 27/1804; F04B 1/295; F04B 1/146; F04B 39/121
USPC ..... 417/218, 222.1, 222.2, 269; 92/71
See application file for complete search history.

(56) References Cited

U.S. PATENT DOCUMENTS 4,037,993 A * 7/1977 Roberts ..... F04B 27/1804 417/222.2
4,178,135 A * 12/1979 Roberts ..... F04B 27/1072 417/222.2
5,259,736 A 11/1993 Terauchi
5,370,503 A 12/1994 Terauchi
6,742,439 B2 6/2004 Matsuda et al.
6,957,604 B1 * 10/2005 Tiedemann ..... F04B 1/295 417/222.1
9,228,576 B2 * 1/2016 Yamamoto ..... F04B 27/18

(Continued)

FOREIGN PATENT DOCUMENTS

JP 52-131204 11/1977
JP 58-162780 9/1983

(Continued)

*Primary Examiner* — Alexander Comley
*Assistant Examiner* — Nathan Zollinger
(74) *Attorney, Agent, or Firm* — Greenblum & Bernstein, P.L.C.

(57) ABSTRACT

In a swash plate type variable displacement compressor, a lug plate includes a cylinder chamber and first and second guide surfaces. Inner peripheral edges of the first and second guide surfaces are defined respectively at parts where the peripheral edge of the cylinder chamber and the guide surfaces overlap with each other. When the inclination angle of a swash plate of the compressor is maximum, first and second guided surfaces and the first and second guide surfaces, respectively are brought into line contact with each other at a first position. At this time, first and second slide contact widths are maximum. When the inclination angle of the swash plate is minimum, the first and second guided surfaces and the first and second guide surfaces, respectively are brought into line contact with each other at a second position. At this time, the first and second slide contact widths are minimum.

5 Claims, 4 Drawing Sheets

(56) References Cited

U.S. PATENT DOCUMENTS

| | | | | |
|---|---|---|---|---|
| 9,228,577 | B2 * | 1/2016 | Yamamoto | F04B 27/1054 |
| 9,273,679 | B2 * | 3/2016 | Suzuki | F04B 27/086 |
| 9,309,874 | B2 * | 4/2016 | Yamamoto | F04B 27/1063 |
| 9,309,875 | B2 * | 4/2016 | Yamamoto | F04B 27/1804 |
| 2012/0073430 | A1 | 3/2012 | Uchikado | |
| 2014/0294614 | A1 * | 10/2014 | Ota | F04B 27/1054 417/222.2 |
| 2014/0294616 | A1 * | 10/2014 | Ota | F04B 27/1072 417/269 |
| 2015/0159645 | A1 * | 6/2015 | Nakaima | F04B 1/146 417/213 |
| 2015/0252798 | A1 * | 9/2015 | Suzuki | F04B 27/1054 417/218 |
| 2015/0275871 | A1 * | 10/2015 | Yamamoto | F04B 27/0878 417/218 |

FOREIGN PATENT DOCUMENTS

| | | |
|---|---|---|
| JP | 61-145379 | 7/1986 |
| JP | 62-225782 | 10/1987 |
| JP | 64-41680 | 2/1989 |
| JP | 1-147171 | 6/1989 |
| JP | 2-16374 | 1/1990 |
| JP | 2-19665 | 1/1990 |
| JP | 3-10082 | 1/1991 |
| JP | 4-54287 | 2/1992 |
| JP | 4-191472 | 7/1992 |
| JP | 5-18355 | 1/1993 |
| JP | 5-172052 | 7/1993 |
| JP | 5-312144 | 11/1993 |
| JP | 8-105384 | 4/1996 |
| JP | 2002-349431 | 12/2002 |
| JP | 2003-507627 | 2/2003 |
| JP | 2007-239722 | 9/2007 |
| JP | 2010-281289 | 12/2010 |

* cited by examiner

SWASH PLATE TYPE VARIABLE DISPLACEMENT COMPRESSOR

BACKGROUND OF THE INVENTION

The present invention relates to a swash plate type variable displacement compressor.

Japanese Unexamined Patent Application Publication No. 52-131204 discloses a swash plate type variable displacement compressor (hereinafter, referred to as the compressor). The compressor includes a housing that has therein a suction chamber, a discharge chamber, a swash plate chamber and a plurality of cylinder bores. A drive shaft is rotatably supported in the housing. The swash plate chamber has therein a swash plate that is rotatable with the drive shaft. The swash plate is of an annular shape having an insertion hole at the center thereof through which the drive shaft is passed. A link mechanism that allows a change in the inclination angle of the swash plate is provided between the drive shaft and the swash plate. The angle of inclination of the swash plate herein refers to an angle of the swash plate with respect to a plane extending perpendicular to the axis of rotation of the drive shaft.

A piston is received in each cylinder bore so that the piston is reciprocally movable in the cylinder bore. The compressor further includes a conversion mechanism that converts the rotation of the swash plate into a reciprocal movement of the piston in the cylinder bore for a length of stroke determined by the inclination angle of the swash plate, an actuator that changes the inclination angle of the swash plate and a control mechanism that controls the actuator.

The link mechanism includes a lug member and an arm. The lug member is fixed on the drive shaft in the front of the swash plate chamber. The arm is connected to the lug member via a connecting pin so as to be swingable with the lug member and the swash plate. The arm transmits the rotation of the lug member to the swash plate and allows a change in the inclination angle of the swash plate while the top dead center of the swash plate being substantially maintained.

The actuator includes the lug member and a movable body that is engaged integrally rotatably with the swash plate and is movable in the direction of axis of rotation of the drive shaft so as to change the inclination angle of the swash plate. Specifically, the lug member has therein a cylinder chamber that has a shape of a cylinder that is coaxial with the axis of rotation of the drive shaft and in which the movable body is movable. In such a structure in which the cylinder chamber is defined by the movable body, a pressure control chamber is formed in the cylinder chamber that controls the movement of the movable body with the pressure in the pressure control chamber. The swash plate has in the insertion hole thereof a hinge ball. The swash plate is mounted on the drive shaft through the hinge ball so that the swash plate is inclinable about the drive shaft. The rear end of the movable body is in contact with the hinge ball. The hinge ball has at the rear end thereof a pressure spring that urges the hinge ball in the direction that increases the inclination angle of the swash plate.

The control mechanism includes control passages and a control valve. Specifically, the control passages include a pressure-changing passage that communicates with the pressure control chamber, a low-pressure passage that communicates with the suction chamber and the swash plate chamber, and a high-pressure passage that communicates with the discharge chamber. A part of the pressure-changing passage is formed in the drive shaft. The control valve controls the opening of the pressure-changing passage, the low-pressure passage and the high-pressure passage. In other words, the control valve controls the communication between the pressure-changing passage and the low-pressure passage or between the pressure-changing passage and the high-pressure passage.

In the compressor, when the control valve permits communication between the pressure-changing passage and the high-pressure passage, the pressure in the pressure control chamber becomes higher than the pressure in the swash plate chamber. Accordingly, the movable body of the actuator is moved away from the lug member and pushes the hinge ball rearward in the swash plate chamber, which decreases the inclination angle of the swash plate. Therefore, the stroke length of the pistons is decreased and the displacement of the compressor also is decreased, accordingly. When the control valve permits communication between the pressure-changing passage and the low-pressure passage, on the other hand, the pressure in the pressure control chamber is decreased to approximately the same pressure as that of the swash plate chamber. Accordingly, the movable body of the actuator is moved toward the lug member. In this case, the hinge ball moves with the movable body because of the urging force of the pressure spring. Accordingly, the inclination angle of the swash plate is increased, and the stroke length of the pistons and hence the displacement of the compressor are increased.

The compressor of the above type is required to change the inclination angle of the swash plate quickly in response to a change in the driving condition of the vehicle on which the compressor is mounted. In order to meet such requirement, the diameter of the pressure control chamber may be increased to move the movable body with an increased thrust force, without increasing the pressure in the pressure control chamber. In this case, however, it is difficult to increase the diameter of the cylinder chamber in the lug member due to the presence of the link mechanism between the drive shaft and the swash plate and, therefore it is difficult to increase the diameter of the pressure control chamber.

Furthermore, in the compressor, the thrust force generated during the operation of the compressor acts on the link mechanism. Therefore, the link mechanism is required to adequately withstand the thrust force. If the diameter of the cylinder chamber is increased by disposing the cylinder chamber closer to the piston than to the thrust bearing, the compressor need be made longer in the axial direction.

The present invention that has been made in view of the above-identified circumstances is directed to providing a swash plate type variable displacement compressor that has good controllability, withstands the thrust force and may be made smaller in the axial direction.

SUMMARY OF THE INVENTION

In accordance with an aspect of the present invention, there is provided a swash plate type variable displacement compressor that includes a housing having therein a suction chamber, a discharge chamber, a swash plate chamber and a plurality of cylinder bores; a drive shaft rotatably supported in the housing and having an axis of rotation; a swash plate that is rotatable in the swash plate chamber with the rotation of the drive shaft; a link mechanism that is disposed between the drive shaft and the swash plate and allows a change in inclination angle of the swash plate with respect to a plane extending perpendicularly to the axis of rotation of the drive shaft; a plurality of pistons that is reciprocally received in the respective cylinder bores; a conversion mechanism that converts the rotation of the drive shaft into reciprocal movement of the pistons in the respective cylinder bores with a stroke length according to the inclination angle of the swash plate; an actuator that changes the inclination angle of the swash plate; and a control mechanism that controls the actuator. The link mechanism includes a lug member that is fixed on the drive shaft in the swash plate chamber and is opposed to the swash plate, and a swash plate arm to which rotation of the drive shaft is transmitted from the lug member. The lug member has an insertion hole through which the drive shaft is inserted, a cylinder chamber that is recessed from the swash plate side of the lug member in such a manner as to surround the insertion hole and a guide surface that guides the swash plate arm. The guide surface has an inner peripheral edge at least part of which is defined at the part where a peripheral edge of the cylinder chamber and the guide surface overlap with each other and extends radially outwardly from the inner peripheral edge. The swash plate arm has a guided surface that slides on the guide surfaces in a radial direction of the drive shaft from an outer peripheral side toward the inner peripheral edge with a decrease of the inclination angle of the swash plate. The actuator has the lug member, a movable body that is disposed between the lug member and the swash plate and movable within the cylinder chamber and a pressure control chamber that is disposed between the cylinder chamber and the movable body and moves the movable body with the pressure in the pressure control chamber. A slide contact width is defined as the width of slide contact between the guide surface and the guided surface in the direction perpendicular to the direction in which the swash plate arm moves. The slide contact width is maximum when the inclination angle of the swash plate is maximum and is minimum when the inclination angle of the swash plate is minimum and the part of the guided surfaces face the cylinder chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the present embodiments together with the accompanying drawings in which.

DETAILED DESCRIPTION OF THE EMBODIMENTS

The following will describe a compressor embodying the present invention with reference to the accompanying drawings. The compressor of the embodiment is a single-head piston swash plate type compressor of variable displacement type. The compressor is mounted on a vehicle and forms a part of refrigeration circuit for an air conditioning system of the vehicle.

Figure 1:
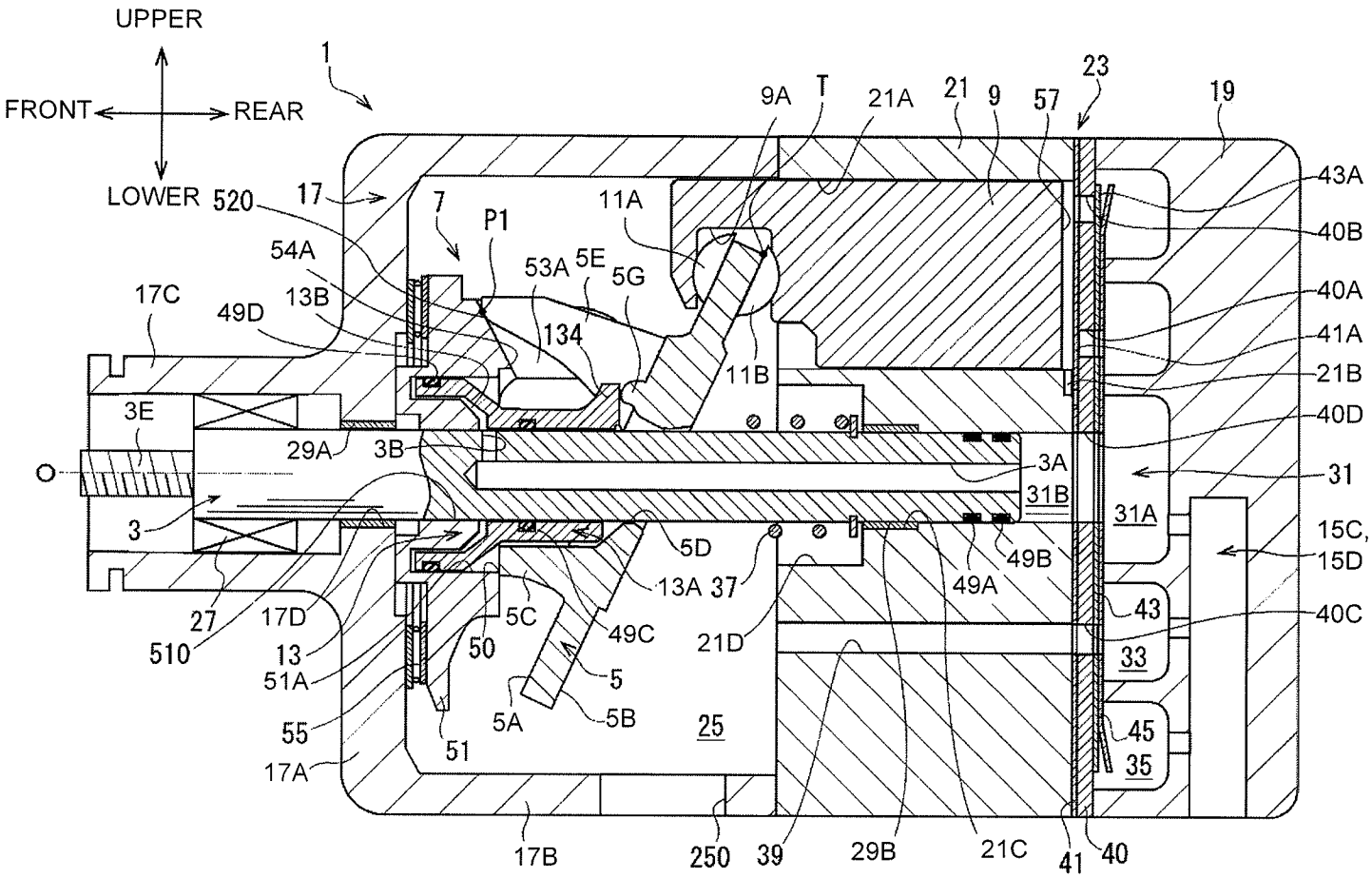
FIG. 1 is a longitudinal cross-sectional view of the compressor according to an embodiment of the present invention showing the maximum displacement of the compressor.
Figure 2:
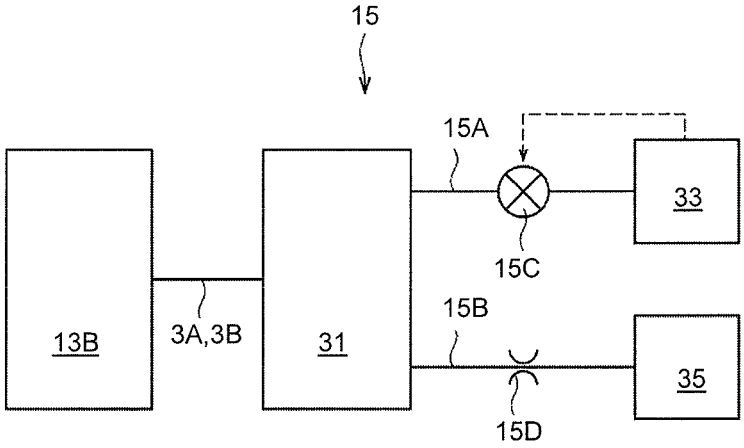
FIG. 2 is a schematic diagram of a control mechanism of the compressor of FIG. 1 according to the embodiment.

Referring to FIG. 1, the compressor according to one embodiment of the present invention includes a housing 1, a drive shaft 3, a swash plate 5, a link mechanism 7, a plurality of pistons 9, plural pairs of shoes 11A, 11B, an actuator 13 and a control mechanism 15 that is shown in FIG. 2. It is to be noted that the shape of a lug plate 51, which will be described later, is shown in FIG. 1 in a partially simplified form for ease of explanation. The same applies to FIG. 6.

As shown in FIG. 1, the housing 1 includes a front housing 17, a rear housing 19, a cylinder block 21 disposed between the front housing 17 and the rear housing 19, and a valve unit 23.

The front housing 17 has a circular front wall 17A extending vertically on the front of the compressor and a peripheral wall 17B that is formed integrally with and extends rearward from the front wall 17A. The front wall 17A and the peripheral wall 17B cooperate to form the front housing 17 of a cylindrical shape with a closed end. Furthermore, the front wall 17A and the peripheral wall 17B cooperate to form a swash plate chamber 25 in the front housing 17.

The front wall 17A of the front housing 17 has a boss 17C projecting frontward. The boss 17C has therein a shaft sealing device 27. The boss 17C has a first shaft hole 17D formed extending in the longitudinal direction of the compressor. A first sliding bearing 29A is mounted in the first shaft hole 17D for radially supporting the drive shaft 3.

The peripheral wall 17B has therethrough an inlet port 250 through which the swash plate chamber 25 communicates with an evaporator (not shown).

The rear housing 19 has therein a part of the control mechanism 15. The rear housing 19 further has therein a first pressure regulation chamber 31A, a suction chamber 33 and a discharge chamber 35. The first pressure regulation chamber 31A is formed at the center of the rear housing 19. The discharge chamber 35 is formed in the rear housing in an annular shape at a position adjacent to the outer periphery of the rear housing 19. The suction chamber 33 is formed in an annular shape between the first pressure regulation chamber 31A and a discharge chamber 35. The discharge chamber 35 is connected to an outlet port (not shown).

A plurality of cylinder bores 21A is formed in the cylinder block 21 substantially at an equally spaced angular distance. The number of the cylinder bores 21A corresponds to the number of the pistons 9. The front end of each cylinder bore 21A and the swash plate chamber 25 communicate with each other. The cylinder block 21 has therein a retaining groove 21B serving as a retainer for restricting the maximum opening of suction reed valves 41A, which will be described later.

Figure 6:
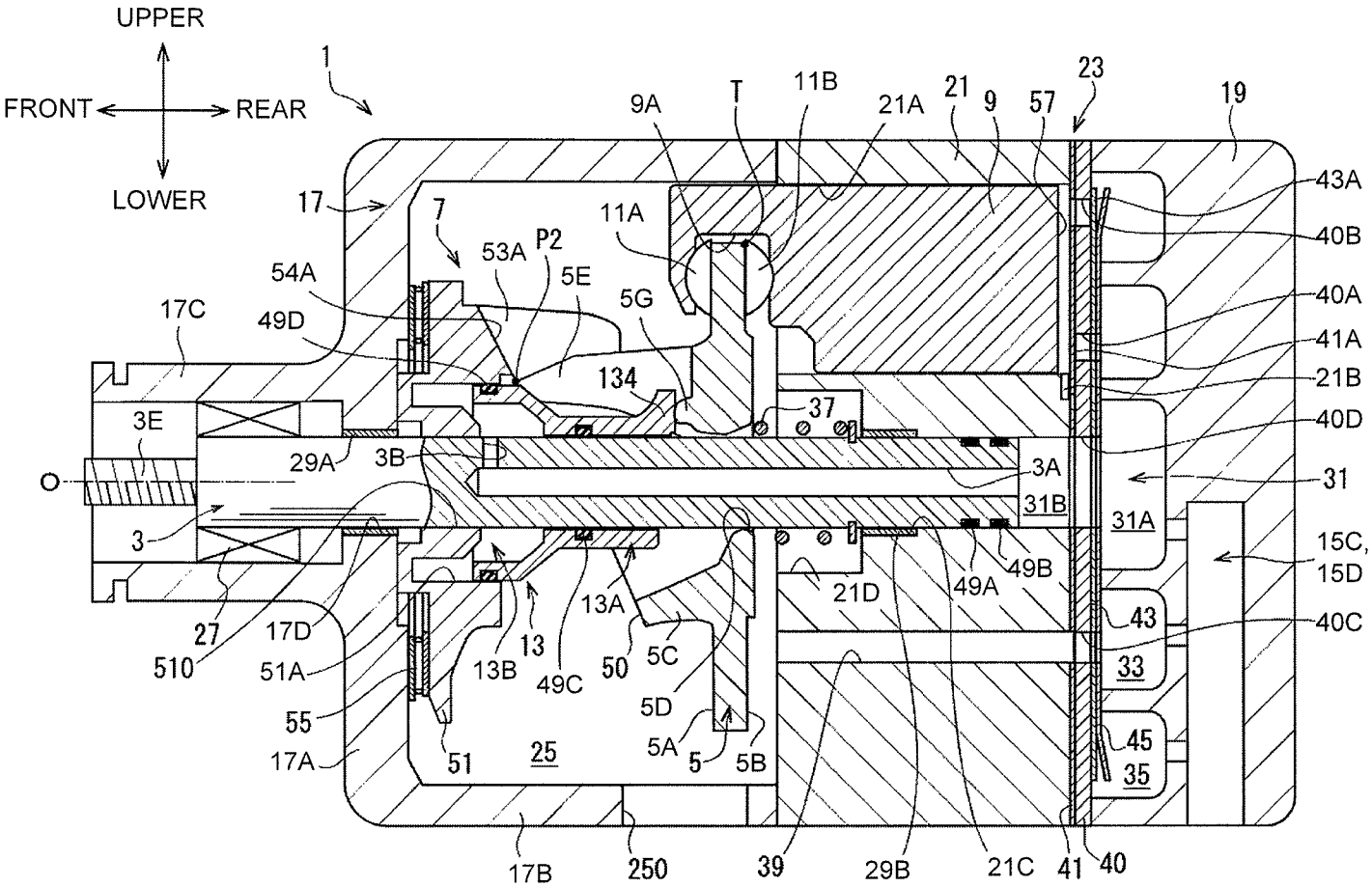
FIG. 6 is a longitudinal cross-sectional view of the compressor of FIG. 1 according to the embodiment in the minimum displacement.

The cylinder block 21 further has therein a second shaft hole 21C that extends in the longitudinal direction of the compressor and communicates with the swash plate chamber 25. The second shaft hole 21C is provided with a second sliding bearing 29B. A spring chamber 21D is formed in the cylinder block 21 between the swash plate chamber 25 and the second shaft hole 21C and a return spring 37 is disposed in the spring chamber 21D. The return spring 37 urges the swash plate 5 at the minimum inclination angle toward the front of the swash plate chamber 25, as shown in FIG. 6. A suction passage 39 is formed in the cylinder block 21 in communication with the swash plate chamber 25.

The valve unit 23 is provided between the rear housing 19 and the cylinder block 21. The valve unit 23 includes a valve plate 40, a suction valve plate 41, a discharge valve plate 43 and a retaining plate 45.

A suction port 40A is formed through the valve plate 40, the discharge plate 43 and the retaining plate 45. The suction port 40A corresponds to each cylinder bore 21A. A discharge port 40B is formed through the valve plate 40 and the suction valve plate 41. The discharge port 40B corresponds to each cylinder bore 21A. Each cylinder bore 21A is communicable with the suction chamber 33 through the suction port 40A and also with the discharge chamber 35 through the discharge port 40B. A first communication hole 40C and a second communication hole 40D are formed through the valve plate 40, the suction valve plate 41, the discharge valve plate 43 and the retaining plate 45. The first communication hole 40C provides communication between the suction chamber 33 and the suction passage 39.

The suction valve plate 41 is provided on the front surface of the valve plate 40 and has a plurality of the aforementioned reed valves 41A that are elastically deformable to open and close the respective suction ports 40A. The discharge valve plate 43 is provided on the rear surface of the valve plate 40 and has a plurality of discharge reed valves 43A that are elastically deformable to open and close the respective discharge ports 40B. The retaining plate 45 provided on the rear surface of the discharge valve plate 43 restricts the maximum opening of the discharge reed valve 43A.

The drive shaft 3 is passed from the boss 17C side to the rear side of the housing 1. The drive shaft 3 is passed at the front end thereof through the shaft sealing device 27 in the boss 17C. The front end of the drive shaft 3 is supported by the first sliding bearing 29A in the first shaft hole 17D and the rear end of the drive shaft 3 is supported by the second sliding bearing 29B in the second shaft hole 21C. Thus the drive shaft 3 is supported in the housing 1 rotatably about the axis of rotation O. The second shaft hole 21C defines a second pressure regulation chamber 31B with the rear end of the drive shaft 3. The second communication hole 40D provides fluid communication between the first pressure regulation chamber 31A and the second pressure regulation chamber 31B. The first and second pressure regulation chambers 31A, 31B cooperate to form the pressure regulation chamber 31.

The drive shaft 3 has at the rear end thereof O-rings 49A, 49B that seal the pressure regulation chamber 31, so that there is no fluid communication between the swash plate chamber 25 and the pressure regulation chamber 31.

Figure 3:
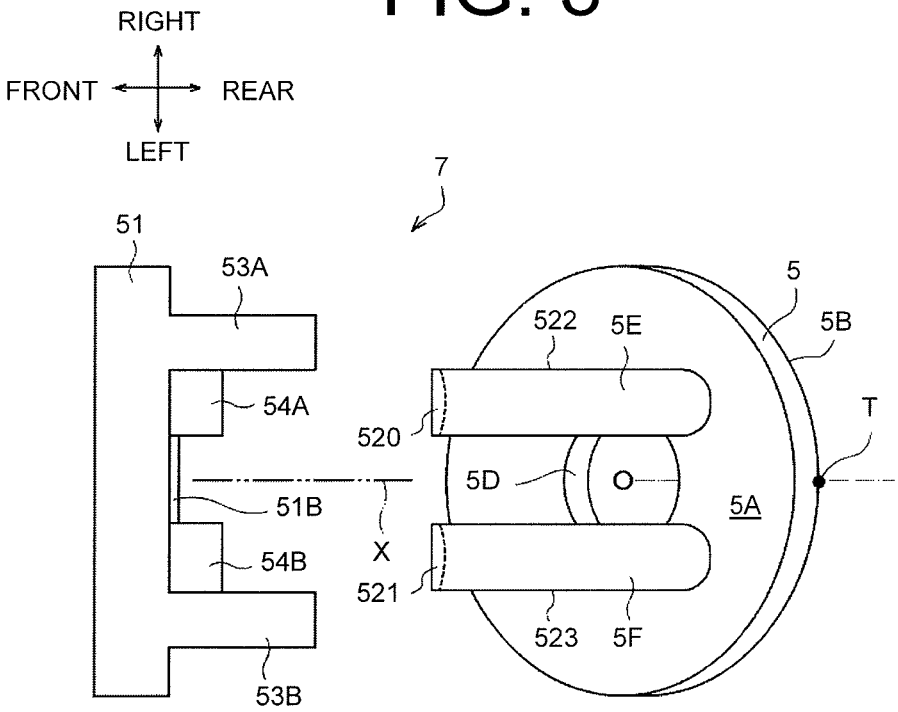
FIG. 3 is a top view schematically illustrating a link mechanism of the compressor of FIG. 1 according to the embodiment.

The link mechanism 7, the swash plate 5 and the actuator 13 are mounted on the drive shaft 3. As shown in FIG. 3, the link mechanism 7 includes the lug plate 51, first and second drive arms 53A, 53B formed extending from the lug plate 51 and first and second swash plate arms 5E, 5F formed extending from the swash plate 5. The lug plate 51 corresponds to the lug member of the present invention.

Figure 4:
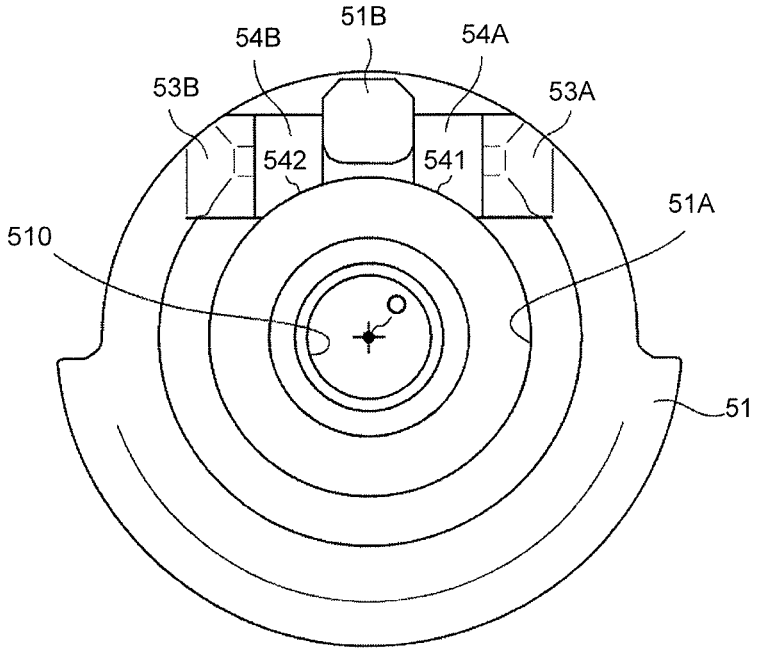
FIG. 4 is a front view of a lug plate of the compressor of FIG. 1 according to the embodiment.

As shown in FIG. 4, the lug plate 51 has an annular shape having an insertion hole 510 at the center thereof. Now referring back to FIG. 1, the lug plate 51 is fixedly mounted on the drive shaft 3 by press-fitting in the insertion hole 510 for rotation therewith. The lug plate 51 is disposed in the swash plate chamber 25 at a position frontward of the swash plate 5 close to the front end of the swash plate chamber 25. The lug plate 51 and the swash plate 5 are disposed in opposed relation to each other. A thrust bearing 55 is provided between the lug plate 51 and the front wall 17A of the front housing 17.

A cylindrical cylinder chamber 51A is recessed in the lug plate 51, extending in the axial direction of the lug plate 51. Specifically, the cylinder chamber 51A is recessed from the rear end of the lug plate 51 on the side thereof adjacent to the swash plate 5 to a position that is radially inward of the thrust bearing 55 in the lug plate 51, so as to surround the insertion hole 510. As shown in FIG. 4, the cylinder chamber 51A is coaxial with the insertion hole 510 and formed at the center of the lug plate 51.

As shown in FIG. 3, the first and second drive arms 53A, 53B extending rearward from the lug plate 51 are formed in a pair across an imaginary plane X that extends through the top dead center position T of the swash plate 5 and the axis of rotation O.

Furthermore, the lug plate 51 has first and second guide surfaces 54A, 54B. The first and second guide surfaces 54A, 54B are also formed in a pair across the above plane X through the top dead center position T. The first guide surface 54A is formed adjacent to the first drive arm 53A of the lug plate 51 and the second guide surface 54B is formed adjacent to the second drive arm 53B, respectively. The lug plate 51 further has a raised surface 51B that is raised rearward between the first and second guide surfaces 54A, 54B.

Figure 5:
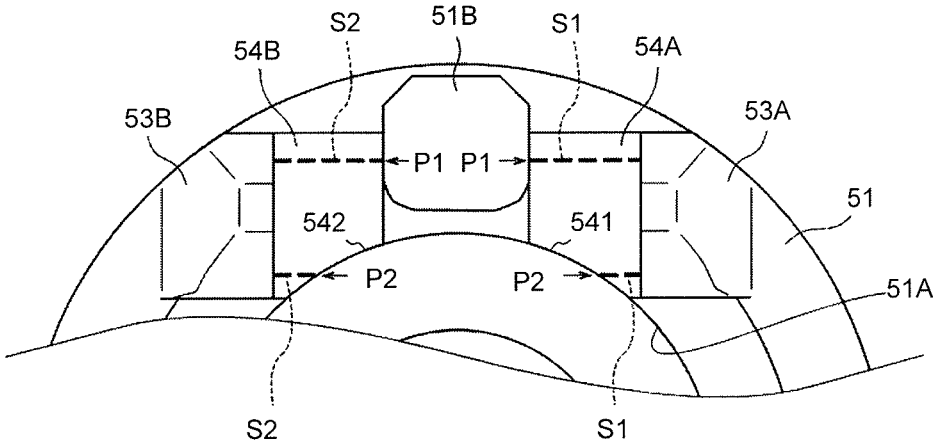
FIG. 5 is a partially enlarged front view showing a part of the lug plate of the compressor of FIG. 1 according to the embodiment.

As shown in FIG. 5, each of the first and second guide surfaces 54A, 54B has a substantially rectangular shape extending from a position radially outward of the lug plate 51 toward the cylinder chamber 51A. The first guide surface 54A has an inner peripheral edge 541 on the cylinder chamber 51A side and the second guide surface 54B has an inner peripheral edge 542 on the cylinder chamber 51A side.

The inner peripheral edges 541, 542 of the respective first and second guide surfaces 54A, 54B have an arcuate shape. In other words, in the lug plate 51, the respective inner peripheral edges 541, 542 are defined at parts where the peripheral edge of the cylinder chamber 51 and the guide surfaces 54A, 54B overlap with each other. Therefore, in the part of the respective first and second guide surfaces 54A, 54B that have the inner peripheral edges 541, 542, the area of the rectangle is gradually reduced toward the cylinder chamber 51A.

As shown in FIG. 1, the first and second guide surfaces 54A, 54B are formed inclined rearward from the front outer periphery toward inner peripheral edges 541, 542.

As shown in FIG. 1, the swash plate 5 is of a circular plate shape having a front surface 5A and a rear surface 5B. The front surface 5A has a weight portion 5C having a substantially cylindrical shape and projecting frontward. The weight portion 5C has at thereof a front end face 50. A part of the front end face 50 of the weight portion 5C comes into contact with the lug plate 51 when the swash plate 5 is positioned at the maximum inclination angle, as shown in FIG. 1. The swash plate has an insertion hole 5D at the center thereof through which the drive shaft 3 is passed.

As shown in FIG. 3, the first and second swash plate arms 5E, 5F extend frontward from the front surface 5A of the swash plate 5. The first swash plate arm 5E and the second swash plate arm 5F are also formed in a pair across the plane X of the top dead center position T. The first swash plate arm 5E has at the end thereof a first guided surface 520 and the second swash plate arm 5F has at the end thereof a second guided surface 521. The right surface of the first swash plate arm 5E as viewed toward the lug plate 51 serves as a first drive transmission surface 522 and the left surface of the second swash plate arm 5E as viewed toward the lug plate 51 serves as a second drive transmission surface 523. It is to be noted that the illustration of the first and second swash plate arms 5E, 5F and other parts are simplified in FIG. 3 for ease of explanation and the weight portion 5C and the projecting part 5G of the swash plate 5 are omitted from illustration in FIG. 3.

Furthermore, as shown in FIG. 1, the projecting part 5G is formed projecting from the front surface 5A of the swash plate 5. The projecting part 5G is formed substantially semispherical and located between the first swash plate arm 5E and the second swash plate arm 5F.

In the compressor of the present embodiment, the drive shaft 3 is assembled to the swash plate 5 with the first and second swash plate arms 5E, 5F inserted between the first and second drive arms 53A, 53B, as shown in FIG. 3. In assembling the drive shaft 3 to the swash plate 5, the raised surface 51B is located between the first swash plate arm 5E and the second swash plate arm 5F. In other words, the lug plate 51 and the swash plate 5 are connected to each other with the first and second swash plate arms 5E, 5F being located between the first and second drive arms 53A, 53B. Rotation of the drive shaft 3 is transmitted from the first drive arm 53A to the first drive transmission surface 522 of the first swash plate arm 5E also the second drive arm 53B to the second drive transmission surface 523 of the second swash plate arm 5F. The swash plate 5 is thus rotatable with the lug plate 51 in the swash plate chamber 25.

The first and second swash plate arms 5E, 5F are located between the first and second drive arms 53A, 53B, so that the first guided surface 520 is abutted to the first guide surface 54A and the second guided surface 521 is abutted to the second guide surface 54B. The first and second guided surfaces 520, 521 are slidable on the first and second guide surfaces 54A, 54B, respectively in the range between a first position P1 and a second position P2 shown in FIG. 5. Accordingly, the inclination angle of the swash plate 5 with respect to a plane extending perpendicularly to the axis of rotation O is changeable between the maximum inclination angle shown in FIG. 1 and the minimum inclination angle shown in FIG. 6, while the top dead center position T of the swash plate 5 being substantially maintained.

The first and second guided surfaces 520, 521 sliding on the respective first and second guide surfaces 54A, 54B are in line contact with the first guide surfaces 54A, 54B as indicated by the dashed line in FIG. 5. The width for which the first guided surface 520 is in slide contact with the first guide surface 54A will be referred to as a first slide contact width S1. The width for which the second guided surface 521 is in slide contact with the second guide surface 54B will be referred to as a second slide contact width S2. AS shown in FIG. 5, the first slide contact width S1 extends in the direction perpendicular to the moving direction of the first swash plate arm 5E and the second slide contact width S2 extends in the direction perpendicular to the moving direction of the second swash plate arm 5F.

In the lug plate 51 in which the cylinder chamber 51A overlaps with the first and second guide surfaces 54A, 54B, the first and second guide surfaces 54A, 54B are shaped such that the area of the respective first and second guide surfaces 54A, 54B are reduced along the inner peripheral edges 541, 542, respectively. Therefore, the first and second slide contact widths S1, S2 are reduced toward the second position P2. Specifically, the slide contact widths S1, S2 are reduced toward the second position P2 in the area of the first and second guide surfaces 54A, 54B that is about one fourth of the respective entire areas and adjacent to the cylinder chamber 51A. The one-fourth of the areas in which the first and second slide contact widths S1, S2 are reduced correspond to the specified inclination angle of the swash plate 5 which will be described later. In the remaining three-fourth radially outer areas of the first and second guide surfaces 54A, 54B that are radially outward portion of the first and second guide surfaces 54A, 54B, the first and second slide contact widths S1, S2 remain substantially constant and larger than in the radially inner one-fourth area.

As shown in FIG. 1, the actuator 13 includes the lug plate 51, a movable body 13A and a pressure control chamber 13B.

The movable body 13A is mounted on the drive shaft 3. The movable body 13A is in slide contact with the drive shaft 3 and is movable in the direction of the axis of rotation O. The movable body 13A has a cylindrical shape which is coaxial with the drive shaft 3. The diameter of the movable body 13A is smaller than that of the thrust bearing 55. The diameter of the movable body 13A gradually increases toward the front of the compressor.

The movable body 13A has at the rear end thereof an acting part 134 that is formed integrally with the movable part 13A. The acting part 134 extends radially outward the top dead center position T of the swash plate 5, and is in point contact with the projecting part 5G of the swash plate 5. The movable body 13A is rotatable with the lug plate 51 and the swash plate 5.

Inserting the front end of the movable body 13A into the cylinder chamber 51 fits the movable body 13A in the lug plate 51. When the movable body 13A is moved as far as it will go into the cylinder chamber 51, the front end of movable body 13A is positioned radially inward of the thrust bearing 55.

The pressure control chamber 13B is defined by the front end of the movable body 13A, the cylinder chamber 51A and the drive shaft 3. The pressure control chamber 13B is sealed by the O-rings 49C, 49D that are provided on the inner peripheral side and the outer peripheral side of the movable body 13A, respectively. The pressure control chamber 13B is shut off from with the swash plate chamber 25.

The drive shaft 3 has therein an axial passage 3A that extends from the rear end toward the front end of the drive shaft 3 in the direction of the axis of rotation O and a radial passage 3B that extends from the front end of the axial passage 3A in the radial direction and is opened in the outer peripheral surface of the drive shaft 3. The rear end of the axial passage 3A is opened to the pressure regulation chamber 31. The radial passage 3B is opened to the pressure control chamber 13B. The pressure regulation chamber 31 and the pressure control chamber 13B are in communication with each other via the axial passage 3A and the radial passage 13B.

The drive shaft 3 has at the front end thereof a threaded portion 3E and is connected to a pulley or an electromagnetic clutch (not shown) through the threaded portion 3E.

The pistons 9 are received in the respective cylinder bores 21A so that the pistons 9 are reciprocally movable in the respective cylinder bores 21A. In each of the cylinder bores 21A, a compression chamber 57 is defined by the piston 9 and the valve unit 23.

Each piston 9 has a recessed engaging part 9A. A pair of hemispherical shoes 11A, 11B is received in the engaging part 9A. The shoes convert the rotation of the swash plate 5 into the reciprocating motion of the pistons 9 in the cylinder bores 21A. The shoes 11A, 11B correspond to the conversion mechanism of the present invention. The pistons 9 are reciprocable in the respective cylinder bores 21A for a stroke length that is determined by the inclination angle of the swash plate 5.

As shown in FIG. 2, the control mechanism 15 includes a low-pressure passage 15A, a high-pressure passage 15B, a control valve 15C, an orifice 15D, the aforementioned axial passage 3A and the radial passage 3B. The low-pressure passage 15A, the high-pressure passage 15B, the axial passage 3A and the radial passage 3B cooperate to form the control passage of the present invention. The axial passage 3A and the radial passage 3B function as a pressure-changing passage.

The low-pressure passage 15A is connected to the pressure regulation chamber 31 and the suction chamber 33. The pressure control chamber 13B, the pressure regulation chamber 31 and the suction chamber 33 communicate with each other through the low-pressure passage 15A, the axial passage 3A and the radial passage 3B. The high-pressure passage 15B is connected to the pressure regulation chamber 31 and the discharge chamber 35. The pressure control chamber 13B, the pressure regulation chamber 31 and the discharge chamber 35 communicate with each other through the high-pressure passage 15B, the axial passage 3A and the radial passage 3B. The orifice 15D is connected in the high-pressure passage 15B.

The low-pressure passage 15A has therein the control valve 15C. The control valve 15C restricts the opening of the low-pressure passage 15A based on the pressure in the suction chamber 33.

The aforementioned evaporator is connected to the inlet port 250 of the compressor through a tube and a condenser is connected to the outlet port through a tube. The condenser is connected to the evaporator through a tube and an expansion valve. The compressor, the evaporator, the expansion valve, the condenser and other devices cooperate to form a refrigeration circuit of a vehicle air conditioning system. It is to be noted that the evaporator, the expansion valve, the condenser and tubes are omitted from illustration in the drawings.

During the operation of the above-described compressor, the rotation of the drive shaft 3 rotates the swash plate 5, causing the pistons 9 to reciprocate in the cylinder bores 21A. The displacement of the compressor varies according to the stroke length of the pistons 9 that is determined by the inclination angle of the swash plate 5. The refrigerant gas that is delivered from the evaporator and drawn into the swash plate chamber 25 through the inlet port 250 is flowed through the suction passage 39, the suction chamber 33 and the compression chamber 57 for compression. The refrigerant gas compressed in the compression chamber 57 is discharged into the discharge chamber 35 and then into the condenser through the outlet port.

During the operation of the compressor, the compression force of the pistons acts on the swash plate 5 and the lug plate 51 in the direction that causes the inclination angle of the swash plate 5 to reduce. In the swash plate type variable displacement compressor, the inclination angle of the swash plate is varied to increase or decrease the stroke length of the pistons 9 to thereby control the displacement of the compressor.

Specifically, when the opening of the control valve 15C in the low-pressure passage 15A shown in FIG. 2 is increased, the pressures in the pressure regulation chamber 31 and hence the pressure control chamber 13B become substantially the same as the pressure in the suction chamber 33. As a result, the volume of the pressure control chamber 13B of the actuator 13 is decreased and the movable body 13A of the actuator 13 is moved toward the lug plate 51 along the axis of rotation O, as shown in FIG. 1. Then the front end of the movable body 13A enters the cylinder chamber 51A.

The first swash plate arm 5E of the swash plate 5 receiving the compression force of the pistons 9 and the urging force of the return spring 37 slides along the first guide surface 54A radially outwardly from the inner peripheral edge 541 side and away from the axis of rotation O of the drive shaft 3. Similarly, the second swash plate arm 5F also slides along the second guide surface 54B radially outwardly from the inner peripheral edge 542 side. In other words, as shown in FIG. 5, the first and second guided surfaces 520, 521 of the first and second swash plate arms 5E, 5F slide along the first and second guide surfaces 54A, 54B, respectively from the second position P2 to the first position P1 (shown in FIGS. 1 and 5).

Therefore, as shown in FIG. 1, the bottom dead center of the swash plate 5 swings clockwise while the top dead center position T of the swash plate 5 being substantially maintained. Accordingly, the inclination angle of the swash plate 5 is increased and the stroke length of the pistons 9 is increased so that the displacement of the compressor per one rotation of the drive shaft 3 increases. It is to be noted that the inclination angle of the swash plate 5 shown in FIG. 1 is maximum inclination angle of the compressor.

When the swash plate 5 is at its maximum inclination angle, the first guided surface 520 is in line contact with the first guide surface 54A at the first position P1 that is indicated by the dashed line in FIG. 5. The second guided surface 521 is in line contact with the second guide surface 54B at the first position P1. Then, the slide contact widths S1, S2 are substantially the same and the largest. When the slide contact widths S1, S2 are the largest, the entire first guided surface 520 is in contact with the first guide surface 54A and the entire second guided surface 521 is in contact with the second guide surface 54B.

When the opening of control valve 15C in the low-pressure passage 15A is reduced, on the other hand, the pressure in the pressure regulation chamber 31 and hence the pressure in the pressure control chamber 13B are increased. Therefore, the volume of the pressure control chamber 13B of the actuator 13 is increased, the movable body 13A is moved away from the lug plate 51 toward the swash plate 5 along the axis of rotation O of the drive shaft 3, as shown in FIG. 6.

Accordingly, the acting part 134 of the movable body 13A pushes the projecting part 5G of the swash plate 5 rearward in the swash plate chamber 25. Therefore, the swash plate arm 5E slides along the first guide surface 54A toward the inner peripheral edge 541 and also toward the axis of rotation O. Similarly, the second swash plate arm 5F slides along the second guide surface 54B toward the inner peripheral edge 542 from the outer peripheral side. In other words, the first and second guided surfaces 520, 521 slide along the first and second guide surfaces 54A, 54B, respectively from the first position P1 to the second position P2.

Therefore, the bottom dead center of the swash plate 5 swings counterclockwise while the top dead center position T of the swash plate 5 being substantially maintained, as shown in FIG. 6. Accordingly, in the compressor, the inclination angle of the swash plate 5 with respect to the axis of rotation O of the drive shaft is decreased. As a result, the stroke length of the pistons 9 is decreased and the displacement of the compressor per one rotation of the drive shaft 3 is decreased, accordingly. Furthermore, with a decrease of the inclination angle of the swash plate 5, the swash plate 5 is brought into contact with the return spring 37. It is to be noted that the inclination angle of the swash plate 5 shown in FIG. 6 is minimum inclination angle in the compressor of the present embodiment.

When the swash plate 5 is at its minimum inclination angle, the first guided surface 520 is in line contact with the first guide surface 54A at the second position P2 indicated by the dashed line in FIG. 5. The second guided surface 521 is in line contact with the second guide surface 54B at the second position P2. Then, the slide contact widths S1, S2 are substantially the same and the smallest.

As shown in FIG. 4, the cylinder chamber 51A is formed at the center of the lug plate 51 and the rectangular first and second guide surfaces 54A, 54B extending toward the inner peripheral edges 541, 542, respectively from the radially outward are formed.

When the swash plate 5 of the compressor is inclined between its maximum inclination angle and the minimum inclination angle, the first and second guided surfaces 520, 521 slide on the first and second guide surfaces 54A, 54B between the first position P1 and the second position P2. As the first and second guided surfaces 520, 521 are moved in sliding contact with the first and second guide surfaces 54A, 54B toward the second position P2 in the one-fourth area thereof adjacent to the inner peripheral edges 541, 542, the contact widths S1, S2 are reduced. During such reduction of the first and second slide contact widths S1, S2, part of the first and second guided surfaces 520, 521 are in slide contact with the first and second guide surfaces 54A, 54B, respectively, while remaining part of the first and second guided surfaces 520, 521 that are not in contact with the first and second guide surfaces 54A, 54B are located on the cylinder chamber 51A side so as to face the cylinder chamber 51A.

As described above, the lug plate 51 is formed such that the cylinder chamber 51A overlaps with the first and second guide surfaces 54A, 54B and overlapping parts are defined as the inner peripheral edges 541, 542 of the first and second guide surfaces 54A, 54B. Therefore, in the compressor, the diameter of the cylinder chamber 51A can be increased for the length for which the cylinder chamber 51A overlaps with the first and second guide surfaces 54A, 54B, without positioning the cylinder chamber 51A on the pistons 9 side, that is, on the rearward of the thrust bearing 55. Therefore, the diameter of the pressure control chamber 13B of the compressor can be increased. Accordingly, in the compressor, the movable body 13A can be moved with a large thrust force, without excessively increasing the pressure in the pressure control chamber 13B. The compressor according to the present embodiment can change the inclination angle of the swash plate 5 quickly in response to the variable driving condition of the vehicle.

Furthermore, since the guide surfaces 54A, 54B of the compressor have the above described shape, the first and second guided surfaces 520, 521 slide on the first and second guide surfaces 54A, 54B, respectively while keeping the first and second slide contact widths S1, S2 constant until the inclination angle of the swash plate 5 reaches one fourth of the maximum inclination angle.

Therefore when the swash plate 5 is at an inclination angle other than the maximum angle, the first and second slide contact widths S1, S2 between the first and second guided surfaces 520, 521 and the first and second guide surfaces 54A, 54B, respectively, are the largest until the inclination angle of the swash plate 5 reaches a specified angle. Therefore, a large thrust force acting on the link mechanism 7 while the inclination angle of the swash plate 5 is changing from the maximum inclination angle to the specified angle is supported adequately by the first and second guide surfaces 54A, 54B and the first and second swash plate arms 5E, 5F.

In the compressor, when the inclination angle of the swash plate 5 is reduced from the specified angle, the thrust force acting on the link mechanism 7 is smaller. Therefore, even if the first and second slide contact widths S1, S2 in the first and second guided surfaces 520, 521, respectively are reduced gradually while the inclination angle of the swash plate 5 is changing from the specified value to the minimum angle, the thrust force acting on the link mechanism 7 is supported adequately by the first and second guide surfaces 54A, 54B and the first and second swash plate arms 5E, 5F while the inclination angle of the swash plate 5 is changing from the specified value to the minimum angle.

Especially in the compressor of the present embodiment wherein the first and second guide surfaces 54A, 54B and the first and second swash plate arms 5E, 5F are in pairs, respectively, disposed across the plane X that extends through the top dead center position T of the swash plate 5 and the axis of rotation O, the thrust force is also halved by the plane X of the top dead center position T. Accordingly, the compressor of the present embodiment exhibits good durability.

The compressor according to the present embodiment exhibits good controllability, supports thrust force adequately. Furthermore, it is possible to reduce the axial dimension of the compressor.

Furthermore, in the compressor of the present embodiment wherein the slide contact widths S1, S2 are reduced gradually while the inclination angle of the swash plate 5 is changing from the specified angle to the minimum angle, the thrust force is preferably supported, as compared with the case in which the sliding contact widths S1, S2 are reduced gradually from the maximum width to the minimum width after the inclination angle of the swash plate 5 had reached the specified angle.

Furthermore, in the compressor wherein the first and second drive arms 53A, 53B are in pairs are disposed across the plane X of the top dead center position T, the first and second drive arms 53A, 53B preferably transmit the rotation of the drive shaft 3 to the first and second drive transmission surfaces 522, 523, respectively, and hence to the swash plate 5.

The foregoing description has dealt with the embodiment of the present invention. However, the present invention is not limited to the embodiment and may variously be practiced through modifications within the gist of the invention.

The lug member of the compressor according to the present invention has therein the cylinder chamber and the guide surface. At least a part of the inner peripheral edge of the guide surface is defined at the part where the peripheral edge of the cylinder chamber and the guide surface overlap with each other. In other words, in the lug member of the compressor, the guide surface and the cylinder chamber are formed so as to partially overlap with each other, so that the cylinder chamber may have a larger diameter for the length of the overlapping between the cylinder chamber and the guide surface. In the compressor, when the inclination angle of the swash plate is minimum, part of the guided surface face the cylinder chamber.

When the inclination angle of the swash plate is maximum, the slide contact width is largest and, therefore, a large thrust force may be supported by the guide surface and the swash plate arm. When the inclination angle of the swash plate is smaller than the maximum angle, on the other hand, the thrust force is not very large and, therefore, such thrust force may be supported adequately with a smaller slide contact width. Therefore, the durability of the compressor is not impaired.

The inclination angle of the compressor of the present invention may have a specified angle that is smaller than the maximum angle. The slide contact width is maximum when the inclination angle is in the range between the maximum inclination angle and the specified inclination angle, and when the inclination angle is smaller than the specified inclination angle, the slide contact width is smaller than the maximum width.

In this case, it is possible for the guide surfaces and the guided surfaces to adequately support the thrust fore acting on such surfaces while the inclination angle is in the range between the maximum angle and the set inclination angle. Therefore, the durability of the compressor can be enhanced further. It is to be noted that the specified angle may appropriately be set as desired.

For example, the guide surfaces may be formed such that when the inclination angle is reduced from the specified angle, the slide contact width is reduced gradually from the maximum width to the minimum width. It is preferable that the guide surfaces should be formed so that the slide contact width is gradually reduced especially when the inclination angle is reduced from the specified angle. In this case, the thrust force can be supported more preferably as compared with the case in which the slide contact width is gradually reduced when the inclination angle is reduced from the specified angle.

Furthermore, the specified angle should preferably be in the range between one fourth and one half of the maximum inclination angle of the swash plate. With this setting of the specified angle, the thrust force can more preferably be supported.

The compressor of the present invention exhibits good controllability, adequately supports the thrust force and permits reduction of the length of the shaft.

The present invention is applicable to an air conditioning system or the like.

What is claimed is:

1. A swash plate type variable displacement compressor comprising:

a housing having therein a suction chamber, a discharge chamber, a swash plate chamber and a plurality of cylinder bores;

a drive shaft rotatably supported in the housing and having an axis of rotation;

a swash plate that is rotatable in the swash plate chamber with the rotation of the drive shaft;

a link mechanism that is disposed between the drive shaft and the swash plate and allows a change in inclination angle of the swash plate with respect to a plane extending perpendicularly to the axis of rotation of the drive shaft;

a plurality of pistons that is reciprocally received in the respective cylinder bores;

a conversion mechanism that converts the rotation of the drive shaft into reciprocal movement of the pistons in the respective cylinder bores with a stroke length according to the inclination angle of the swash plate;

an actuator that changes the inclination angle of the swash plate; and a control mechanism that controls the actuator, wherein the link mechanism includes a lug member that is fixed on the drive shaft in the swash plate chamber and is opposed to the swash plate, and a swash plate arm to which rotation of the drive shaft is transmitted from the lug member;

the lug member has an insertion hole through which the drive shaft is inserted, a cylinder chamber that is recessed from the swash plate side of the lug member in such a manner as to surround the insertion hole and a guide surface that guides the swash plate arm;

the guide surface has an inner peripheral edge at least a part of which is defined at a part where a peripheral edge of the cylinder chamber and the guide surface overlap with each other and which extends radially outwardly from the inner peripheral edge;

the swash plate arm has thereon a guided surface that slides on the guide surface in a radial direction of the drive shaft from an outer peripheral side toward the inner peripheral edge with a decrease of the inclination angle of the swash plate;

the actuator including a movable body that is disposed between the lug member and the swash plate and is movable within the cylinder chamber and a pressure control chamber that is formed between the cylinder chamber and the movable body and moves the movable body with the pressure in the pressure control chamber;

a slide contact width is defined as the width of slide contact between the guide surface and the guided surface in the direction perpendicular to the direction in which the swash plate arm moves; and the slide contact width is maximum when the inclination angle of the swash plate is maximum and is minimum by a part of the guided surface facing the cylinder chamber when the inclination angle of the swash plate is minimum.

2. The swash plate type variable displacement compressor according to claim 1, wherein the inclination angle of the swash plate is a specified angle that is smaller than the maximum angle; and the slide contact width is maximum when the inclination angle is in the range between the maximum inclination angle and the specified inclination angle, and when the inclination angle is smaller than the specified inclination angle, the slide contact width is smaller than the maximum width.

3. The swash plate type variable displacement compressor according to claim 2, wherein the guide surface is formed such that when the inclination angle of the swash plate is reduced from the specified angle, the slide contact width is reduced gradually.

4. The swash plate type variable displacement compressor according to claim 2, wherein the specified inclination angle is set between one fourth and one half of the maximum inclination angle of the swash plate.

5. The swash plate type variable displacement compressor according to claim 1, wherein the guide surface includes a first guide surface and a second guide surface that are in a pair across an imaginary plane that extends through the top dead center position of the swash plate and the axis of rotation;

the guided surface includes a first guided surface that slides on the first guide surface in the radial direction and a second guided surface that slides on the second guide surface in the radial direction; and the swash plate arm includes a first swash plate arm on which the first guided surface is formed and a second swash plate arm on which the second guided surface is formed.

* * * * *